US005294024A

United States Patent [19]

David et al.

[11] Patent Number: 5,294,024

[45] Date of Patent: Mar. 15, 1994

[54] DISPENSING APPARATUS AND DISPENSING NOZZLE ATTACHMENT

[75] Inventors: Colin M. David; Bernard J. David, both of London, United Kingdom

[73] Assignee: W. David & Sons Limited, London, United Kingdom

[21] Appl. No.: 793,346

[22] PCT Filed: Aug. 3, 1990

[86] PCT No.: PCT/GB90/01221

§ 371 Date: Jan. 14, 1992

§ 102(e) Date: Jan. 14, 1992

[87] PCT Pub. No.: WO91/01812

PCT Pub. Date: Feb. 21, 1991

[30] Foreign Application Priority Data

Aug. 4, 1989 [GB] United Kingdom ..... 8917833.9
Nov. 15, 1989 [GB] United Kingdom ..... 8925852.9

[51] Int. Cl.[5] ..... B67D 5/52

[52] U.S. Cl. ..... 222/137; 222/327; 222/570

[58] Field of Search ..... 222/137, 145, 566, 326, 222/327, 391, 567, 570, 529, 484

[56] References Cited

U.S. PATENT DOCUMENTS

| | | | |
|---|---|---|---|
| 4,339,058 | 7/1982 | Wendt . | |
| 4,596,341 | 6/1986 | Bruffey | 222/570 X |
| 4,750,644 | 6/1988 | Kolody | 222/484 X |
| 4,753,536 | 6/1988 | Spehar et al. | 222/145 X |
| 4,771,919 | 9/1988 | Ernst | 222/145 X |
| 4,840,294 | 6/1989 | Ernst . | |
| 4,846,373 | 7/1989 | Penn et al. | 222/137 |
| 4,871,090 | 10/1989 | Hoffmann | 222/326 X |
| 4,981,241 | 1/1991 | Keller | 222/145 X |
| 5,062,550 | 11/1991 | Singh | 222/529 X |

FOREIGN PATENT DOCUMENTS

| | | |
|---|---|---|
| 0057465 | 8/1982 | European Pat. Off. . |
| 0294672 | 12/1988 | European Pat. Off. . |
| 0328382 | 8/1989 | European Pat. Off. . |
| 1555455 | 11/1979 | United Kingdom . |

OTHER PUBLICATIONS

International Search Report and Annex.
International Preliminary Examination Report.

*Primary Examiner*—Gregory L. Huson
*Attorney, Agent, or Firm*—Sandler Greenblum & Bernstein

[57] ABSTRACT

Apparatus for dispensing includes a cartridge holder and main body having a generally circular central portion with three perpendicular flanges extending from one side and an elongate portion extending from the other side. A drive means on the elongate portion mounts a U-shaped drive rod for axial movement. Each flange includes a slot for receiving a pin formed on a replaceable generally cylindrical cartridge to act as a bayonet fitting. Viscous material is expelled from the held cartridge by driving the rod axially. A nozzle attachment has a primary section connected to the exit of the cartridge and includes a secondary section for holding a replaceable hardener tube, with the hardener being expelled by axial movement of a portion of the rod. The nozzle attachment includes a planar end surface for simple cleaning.

14 Claims, 3 Drawing Sheets

DISPENSING APPARATUS AND DISPENSING NOZZLE ATTACHMENT

BACKGROUND OF THE INVENTION

1. Field of the Invention

This invention relates to a dispensing apparatus, and in particular to a dispensing apparatus for dispensing viscous material.

2. Discussion of Background Information

Mastics are now being increasingly used as a sealant, filler and adhesive. A typical mastic is a soft putty-like substance which is conveniently contained in a generally cylindrical cartridge from which the mastic can be forced out in a convenient measure for the application at hand. The type of mastic is generally engineered to a particular use, but in many applications this can lead to problems since the eventual viscosity may be such that the mastic is difficult to force out of the cartridge without the use of a special device known as a gun. In fact, the use of a gun is preferred since this can make it simpler to discharge a specific or controlled amount of the mastic in a repeatable manner.

Some mastics also require the use of a catalytic hardener which must be mixed with the mastic. The hardener can either be added after dispensing of the mastic or a hardener cartridge can be incorporated with the gun. In the automotive after market field, for example, use of the correct proportions of mastic to hardener helps solve problems which might arise from the paint formulations applied to modern vehicles. Thus, it is quite common for garages to employ a movable or permanently mounted dispensing gun for dispensing correct proportions of the mastic and hardener.

With the advent of specialized mastics for different applications, it is now common to use more than one type of mastic in a garage, thus requiring either continual changing of the mastic and hardener loaded in the gun or the expense of a number of guns containing different types of mastics.

A known dispensing apparatus or gun for dispensing viscous material that is quite simple and encompasses the common concepts of the prior art is described in UK-A1,555,455. The mastic containing cartridge for such a gun comprises a cylindrical casing full of mastic which has an exit nozzle opening at one end and is closed at the other end by a plate which, provided the casing is fixedly held, can slide along the axis of the casing thereby compressing the mastic and forcing it out of the nozzle.

The gun itself comprises a single plate stock which is stamped to form bridges for guiding and holding a central drive rod which acts on the aforementioned plate of a received cartridge held by the gun. The holder for the cartridge comprises two metal strips which are welded to extend in opposing manner from the stock and have a 90 degree twist adjacent the stock. The end of the strips remote from the stock are welded to a cup-shaped member having a large opening in its base. The cartridge is inserted into the holder between the strips with the plate end of the cartridge being seated against the stock and with the exit nozzle located in the cup-shaped member. A drive rod gripper, gun trigger and gun butt are provided respectively for advancing the drive rod, actuating the advance thereof and for holding the gun.

Where a hardener is required, the gun incorporates a further mounting arrangement for a hardener cartridge having a similar construction to that of the mastic containing cartridge. A secondary rod is provided to force out the hardener at the same time as the mastic. This makes for a relatively expensive piece of equipment for the simple task of dispensing mastic and hardener.

The setting time of the mastic/hardener mix is typically of the order of 15 to 30 minutes. Generally, such a gun is used a number of times during a day, but even then, the mastic and hardener cartridge is often not emptied for some time. Thus, the gun is used repetitively rather than a single shot.

Unfortunately, during use, there often occurs cross-contamination between the hardener and mastic cartridges thus leading to the appearance of small solid bits in later mixes from the gun or even blockage of the cartridges themselves. Moreover, as the gun is repeatedly used, spillage occurs so that set mastic gradually builds up on the gun forcing its eventual replacement.

SUMMARY OF THE INVENTION

It is an object of the present invention to provide an improved dispensing apparatus and nozzle arrangement having fewer of the aforementioned drawbacks than hitherto known.

According to one aspect of the present invention there is provided a nozzle attachment for a generally cylindrical cartridge to be mounted in use to a dispensing apparatus, the attachment comprising:

a hollow primary nozzle section connectable at one end to the cartridge and having an exit aperture at the other end;

a hollow secondary nozzle section connectable at one end to a further cartridge and having an exit aperture at the other end; and a substantially rigid portion linking the two nozzle sections together a distance apart characterized in that the exit apertures define an uninterrupted dispensing exit plane. In this way, the attachment provides a means for rigidly mounting together the two nozzle sections when connected to the two cartridges whilst at the same time providing the exit apertures on an uninterrupted dispensing exit plane to facilitate easy cleaning. Furthermore, the location and securing is assured of what become, in use, the exit apertures of the two cartridges. In addition, the distance between them reduces the risk of cross contamination.

Preferably, the linking portion of the nozzle attachment comprises a planar section linking the exit apertures to provide a substantially continuous surface on the dispensing exit plane. Thus, a surface is provided for the exit apertures which can be simply and easily cleaned by scraping or wiping.

The primary nozzle section conveniently has a generally tubular body and the secondary nozzle section has a generally tubular body, the bodies being connected by the connecting portion to be substantially parallel. This allows for simple manufacture of the attachment.

In one embodiment, the primary nozzle section is permanently connected to the primary cartridge and the secondary nozzle includes releasable connection means for attachment to a further cartridge. Thus, the attachment can be integrally formed with the primary cartridge and at the same time provide a mounting for one end of the further cartridge. This mounting for the further cartridge therefore provides all that is required to mount it.

Alternatively, the one end of the primary nozzle section can include a connecting means to provide a push fit to the first-mentioned cartridge so that the attachment can be simply and easily connected to it. It is also preferred that the connecting means pivotally connects to the first-mentioned cartridge. In this way, the attachment after mounting can be pivoted to extend over the cartridge end. This reduces the risk of damage to the attachment in transit and reduces the size of packaging required for the combined cartridge and attachment.

In another preferred embodiment of the invention, the body of the primary nozzle section includes locating means for mounting the attachment to the dispensing apparatus. Conveniently, the locating means comprises a groove. Consequently, a simple way of mounting the attachment to the dispensing apparatus is achieved. Preferably, the groove includes a locking means to cooperate, in use, with the dispensing apparatus to prevent rotation of the cartridge when mounted to the dispensing apparatus.

The invention is particularly convenient when the nozzle attachment is formed as an integral piece of plastics material. Thus, the various advantages of the nozzle attachment can be provided by a simple and cheap manufacturing process which does not adversely affect the overall cost of producing the cartridges.

In another embodiment of the invention, a lid means is pivotally connected to the body of the primary nozzle section for closing the exit apertures. Thus, a dust or air tight cover for the exit apertures can be provided. In addition, the body of the primary nozzle section includes means for receiving a seal. Consequently, after the manufacturing steps of fitting the attachment to the primary cartridge and filling the cartridge with mastic, a seal can be inserted into the primary nozzle section to seal the primary cartridge to prevent leakage therefrom.

According to another aspect of the present invention there is provided a dispensing apparatus including a nozzle attachment as defined above, the apparatus comprising:- a main body member;

a cartridge holding portion connected to the main body member;

a drive means mounted on the main body portion; and an advance mechanism attached to the main body portion for advancing the drive means to push against the held cartridge to force out material contained therein; wherein the cartridge holder includes a bayonet fitting for cooperating with the received cartridge to fixedly hold the cartridge to the apparatus.

In this way, fewer components than hitherto are required for the apparatus. Moreover, the use of the bayonet fitting avoids the necessity to have side strips and a cup mounting as shown in the prior art above thereby eliminating extra assembly and component costs. In addition, the nozzle attachment provides a means for rigidly mounting together two nozzle sections when connected to two replaceable cartridges whilst at the same time providing the exit apertures on a common plane to facilitate easy cleaning. Furthermore, the location and securing is assured of what become, in use, the exit apertures of the two cartridges. At the same time, the distance between the two cartridges reduces the risk of cross contamination.

Preferably, the slots for the bayonet fitting are provided on the cartridge holding portion to cooperate with pins provided on the cartridge although it will be appreciated that instead the pins for the fitting could be provided on the holding portion with the slots provided on the cartridge. Conveniently, the cartridge holding portion comprises at least three side flanges defining a receiving area for the cartridge, each flange including a bayonet fitting. The cartridge holding portion can be welded to the main body member or the cartridge holding portion and main body member can comprise together a single, integrally formed piece, preferably of metal which is formed into the main body member and holder by stamping and bending of the metal. In this way, the main body member and cartridge holding portion of the apparatus can be formed as a single component thereby saving on component production and assembly costs.

BRIEF DESCRIPTION OF THE DRAWINGS

Examples of the present invention will now be described with reference to the accompanying drawings, in which:-

DETAILED DESCRIPTION OF THE PREFERRED EMBODIMENTS

Figure 1:
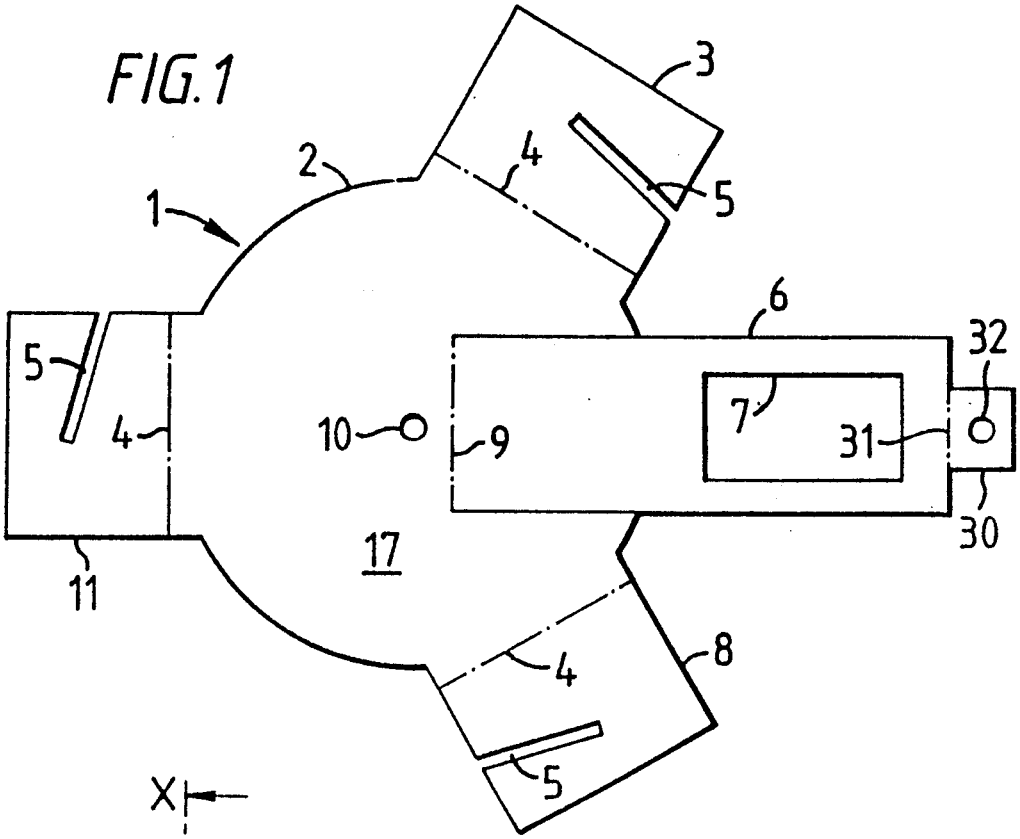
FIG. 1 illustrates a cutting and folding plan for a blank forming the main body and cartridge holder for a dispensing apparatus embodying the present invention.
Figure 2:
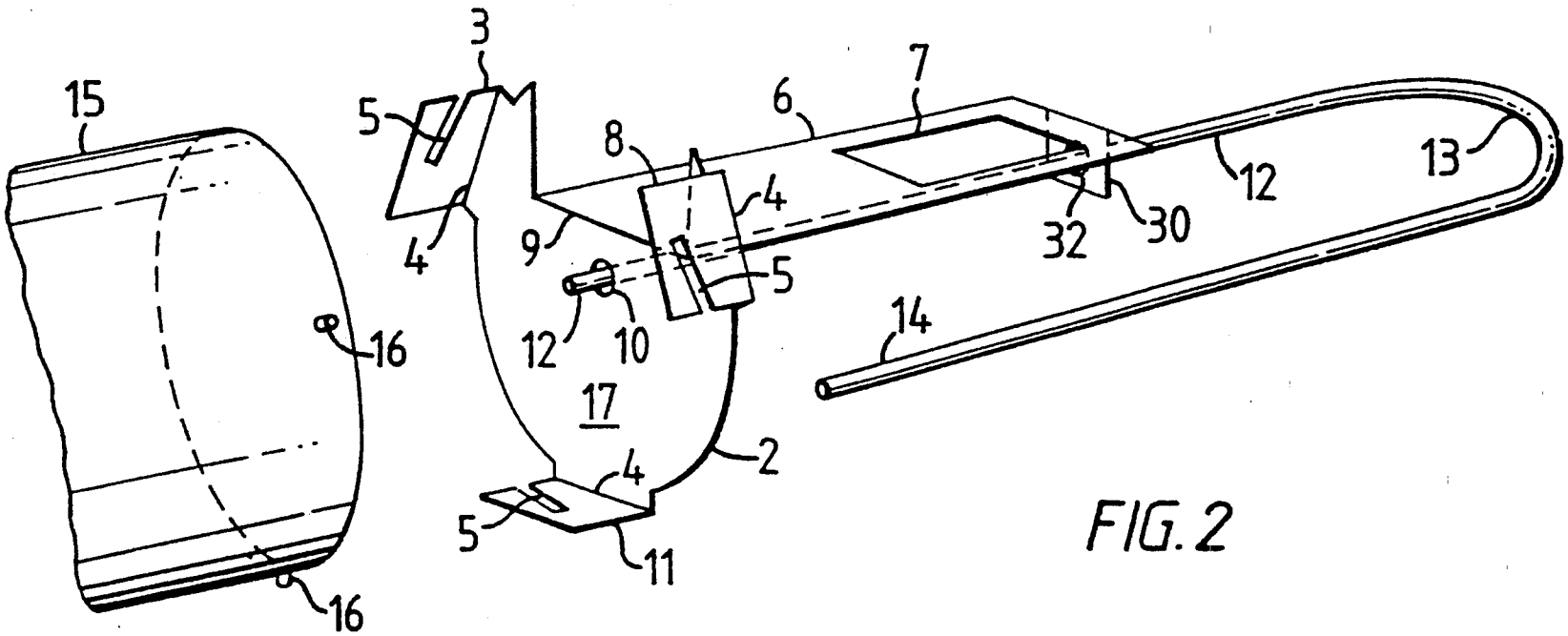
FIG. 2 shows in schematic form the folded main body and cartridge holder of FIG. 1 together with the drive rod.

Referring to FIGS. 1 and 2, a blank 1 for the main body and cartridge holder of a dispensing apparatus embodying the present invention is illustrated after the blank has been cut from a sheet of metal in known manner. The blank comprises a central portion 17 based on a circle 2 and has a central aperture 10. An elongate portion 6 extends from the right hand side of the circle as shown and includes cuts into the circle up to a fold line 9 adjacent the aperture 10 as shown. At the end of the portion 6 remote from the aperture 10, there is provided a tab 30 connected to the portion 6 at a fold line 31. The tab includes a central aperture 32 similar in size to that of aperture 10. An internal rectangular area 7 is cut out from the portion 6 also towards the end remote from the aperture 10.

At 120 degree positions around the circle 2 there are provided rectangular flange portions 3, 8, and 11 which meet the circle at fold lines 4 and give an appearance to the blank of a fan blade. Each flange portion has a side cut 5 as illustrated which is angled away from the aperture 10 towards the edge of the flange portion facing away from the circle 2.

Referring to FIG. 2, this shows in schematic form only the basic components of one embodiment of the apparatus of the present invention which is commonly known as a dispensing gun. The apparatus operates to fixedly hold a mastic containing cartridge as a drive rod is pushed into the cartridge to act on an axially sliding plate so as to expel mastic. When the cartridge is empty, a replacement cartridge is loaded into the apparatus. Since the manner of driving the drive rod and the manner of gripping the apparatus are not relevant to an understanding of the present invention, these aspects are neither described nor illustrated in the figure for the purposes of clarity. However, the actual construction of these aspects and the cooperation thereof with the drawings will be apparent to a person skilled in the art.

The main body and cartridge holder of the present invention is constructed as follows. The portion 6 is bent along fold line 9 to extend perpendicularly away from one side of the central portion 17 and the tab 32 is further bent along fold line 31 so that the tab is parallel to the central portion 17 with the aperture 32 aligned with the aperture 10. The flange portions 3, 8 and 11 are respectively bent along fold lines 4 to extend perpendicularly away from the other side of the central portion 17. The plate end of a cartridge 15, which is formed to have three bayonet pins 16, is loaded into the socket defined by the flange portions 3, 8 and 11. When the cartridge has been received therein, the cartridge is rotated anti-clockwise in the drawing so that the pins 16 engage the cuts 5 as a bayonet fitting. Thus, the cartridge is now loaded in the apparatus and is fixedly held thereto.

The dispensing apparatus shown schematically in FIG. 2 includes a U-shaped rod 12 which has one end passed through the aperture 32 and further locates with the central aperture 10 provided in the central portion 17. Thus, the rod 12 is slidably mounted onto the portion 6 of the main body in a novel way. Since the cartridge is securely held to the holder and main body, when the driving rod is driven along the axis of the cartridge 15 by means not shown, force is exerted on the axially slidable plate of the cartridge to force mastic out from the open end. It will be apparent to a person skilled in the art how the rod 12 can be mounted to the portion 6 and how a drive means can be incorporated to drive the rod. For example a gripper mechanism as shown in UK 1,555,455 could be employed. Similarly, although a trigger and butt portion have not been illustrated for the purposes of clarity, it will be apparent to a person skilled in the art as to how these components can be attached to the member 6 if required. Similarly, the drive rod is illustrated as being in a U-shape so as to act as a drive rod for two cartridges. It will be apparent that where only a single cartridge is employed, the drive rod can comprise substantially a straight rod.

Accordingly, it can be seen that a simple and effective fitting is provided between the cartridge and the holder of the apparatus which is cheap to produce and reduces assembly costs.

Although the construction of the cartridge holder and main body has been described with reference to a single metal piece, it will be apparent to a person skilled in the art that, for example, the flange portions 3, 8, and 11 providing the bayonet fitting could be welded to the central portion 17. This retains the advantage that the side and cup-shaped members of the prior art are not required thereby still saving on component and assembly costs although it will be appreciated that the advantages of employing a single piece of metal sheet to form the holder and main body are lost.

Although the flanges are shown to have slots to receive the pins on the cartridge, it will be appreciated that the slots and pins could be reversed although the pins formed on the flange portions are likely to be difficult to make and are likely to be weaker. It will also be appreciated that the number of flanges forming the bayonet fitting can be varied as can the shape thereof.

The casing of the cartridge is formed to have pins 16 to match the slots in the flanges of the apparatus although it will be appreciated that the pins could be mounted on a sleeve that is then affixed to a cartridge. Alternatively, the cartridge could be formed to have slots which mate with pins on the cartridge holder, formed by for example folding the flange edges remote from the aperture 10. Furthermore, although the present description relates to mastic containing generally cylindrical cartridges, the present invention is not limited thereto.

Figure 4:
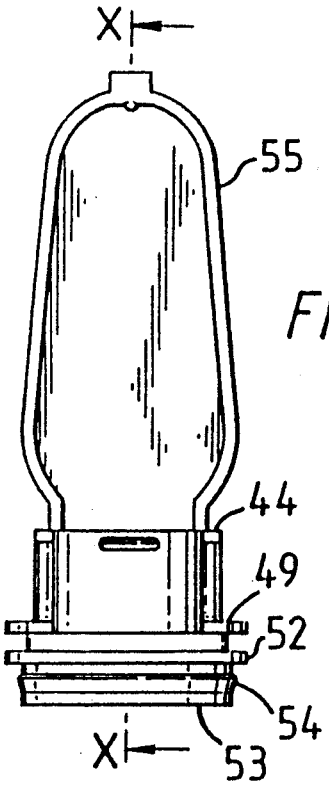
FIG. 4 illustrates a front view of the nozzle attachment shown in FIG. 3 with the lid in the open position.
Figure 5:
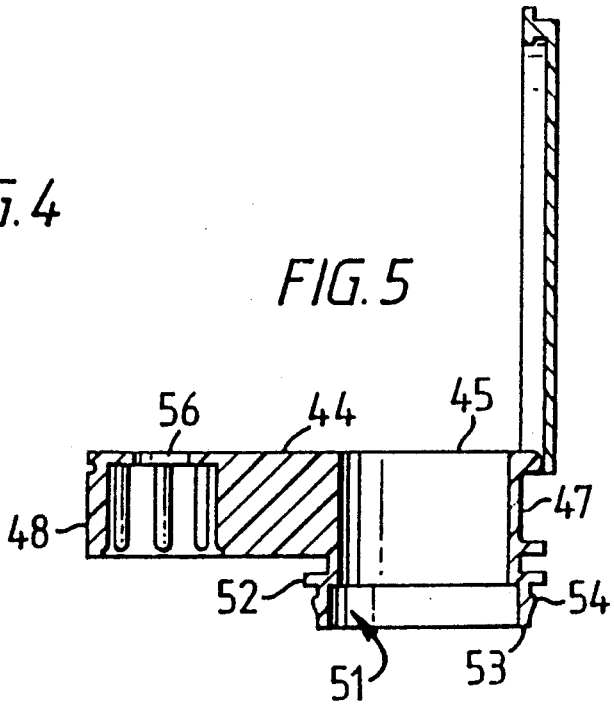
FIG. 5 illustrates a section along the line X—X of the nozzle attachment shown in FIG. 3.
Figure 3:
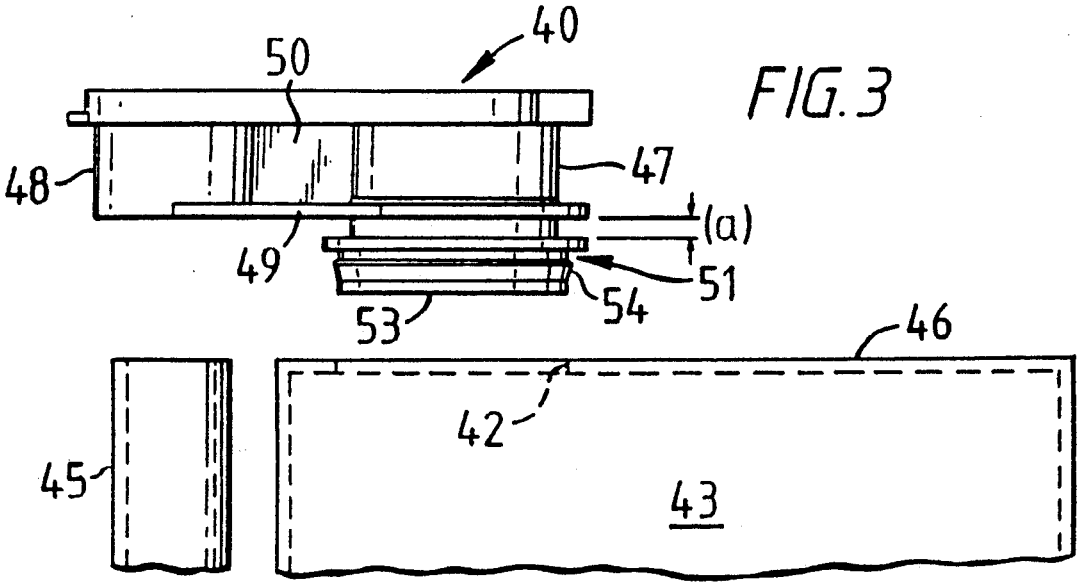
FIG. 3 illustrates a side view of a nozzle attachment suitable for use with a dispensing apparatus.

Referring to FIGS. 3, 4 and 5, a nozzle attachment 40 is to be connected to an exit hole 42 in the end surface 46 of a mastic containing cartridge 43. The attachment 40 comprises an upper planar section 44 having a primary nozzle exit aperture 45 and a secondary nozzle exit aperture 56. A tubular primary body 47 and tubular secondary body 48 connect the upper planar section 44 to a lower planar section 49. A generally rigid connecting flange 50 is provided between the bodies 47 and 48 to reinforce the connection between the upper and lower sections 44 and 49. The connecting portion can have a central aperture (not shown) to reduce consumption of plastics in manufacture. The primary body has a lower extension 51 to connect to a flange 52 at a determined distance (a) from the lower planar section 49 and extends further to a lower edge 53. One or more locking teeth or a continuous ridge 54 are provided at this lower edge.

To connect the attachment 40 to the cartridge 43, the lower edge 53 of the attachment is inserted into the hole 42 and push fitted into place, the teeth or ridge 54 acting to lock the attachment to the cartridge 43. It will be noted that this form of connection allows the attachment 40 to pivot such that the secondary body 48 can be swung to a position over the cartridge end 46 or away from it as illustrated. Other forms of connection between the attachment and hole 42, such as threading or bayonet fitting, can be employed if desired.

Figure 6:
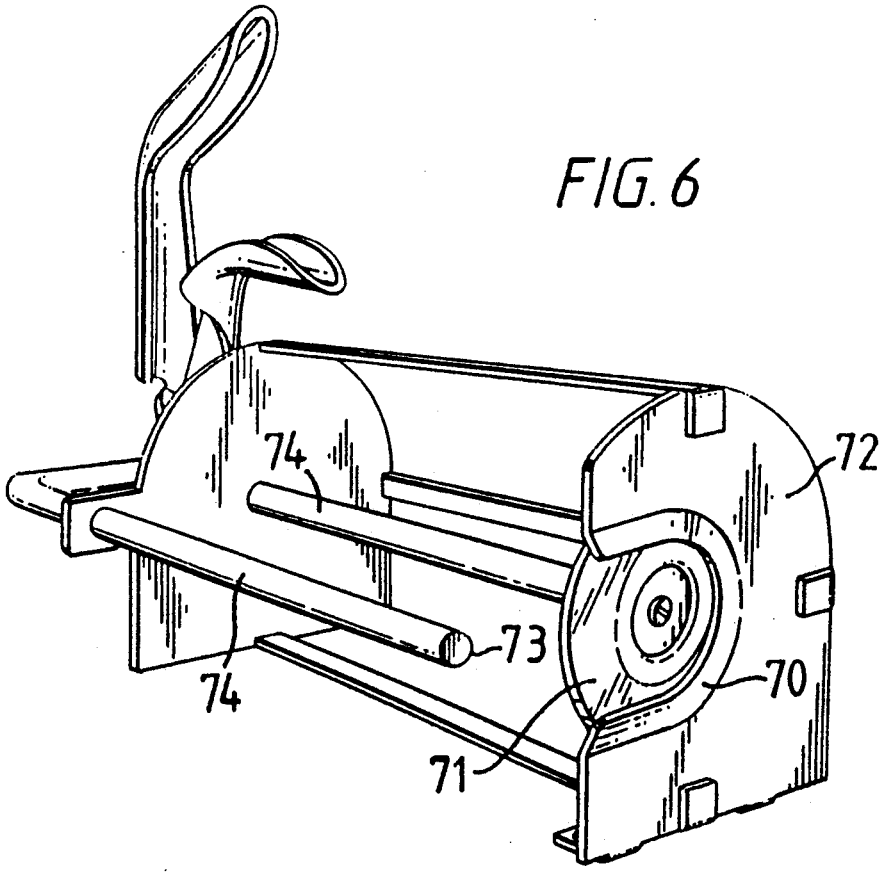
FIG. 6 illustrates an alternative dispensing apparatus for use with the nozzle attachment shown in FIGS. 3, 4 and 5.

Referring also to FIG. 6, the dimension (a) is selected so that the groove defined between the lower section 49 and the flange 52 firmly locates in use with a raised lip 70 defining an aperture 71 in the planar end surface 72 of the dispensing apparatus shown in FIG. 6. A locking extension (not shown) can be integrally formed in this groove so as to mate with a recess in the end surface 72 to prevent any rotation of the cartridge when mounted to the apparatus. Thereafter, a hardener tube 57 is inserted into the lower edge (as illustrated) of the secondary body 48. It can be seen that the hardener tube 57 and cartridge 43 are now aligned parallel with one another. A lid 55 is connected by a hinge to the end of the upper planar section 44 adjacent the primary nozzle exit aperture 45 so that the apertures 45 and 56 can be substantially sealed thereby.

When the cartridge and hardener tube 3 are loaded to the apparatus shown in FIG. 6, it can be seen that the secondary body 48 mounts the hardener tube 57 at one end so that when an end 73 of the drive rod 74 is pushed into the cartridge 43, the body 48 holds the tube 57 in position so that force can be exerted on the contents of that tube so as to force material out of the aperture 56. Thus, the attachment 40 allows a single cartridge to be adapted to bear dual cartridges which can be employed with the apparatus shown in FIG. 6 or adapted to be employed with the apparatus shown in FIGS. 1 and 2. This can be of use when a mastic and hardener are employed.

In addition, it can also be seen that a simple and cheap nozzle attachment can be formed which provides a planar upper surface 44 that can be easily scraped or wiped to clean it. Furthermore, by scraping in a direction away from the primary and secondary exit apertures 45 and 56 (perpendicular to the flange 50), a user can ensure that no contamination takes place between the cartridge and hardener contents. It will be apparent that the attachment described is conveniently formed from a single, integral piece of plastics material. By having a single, integrally formed attachment as shown, the attachment can mate with a dispensing apparatus whilst the secondary body 48 provides a mounting for a hardener tube 57. Thus, a simpler dispensing apparatus can be employed.

Preferably, the attachment is mounted to an empty cartridge 43 and filled with mastic. Then a suitable removable closure member is provided in the primary body 47. This full cartridge together with a hardener tube 57 can be sold to owners of a suitable dispensing apparatus or together with such an apparatus. The attachment can be located such that the secondary body 48 lies over the cartridge end 46 thereby reducing the likelihood of damage to the attachment in transit and reducing the packing space required for the combined cartridge, hardener tube and attachment. When a user wishes to use mastic, the attachment is pivoted to the position illustrated in the drawing, the cartridge is mounted to the dispensing apparatus with a hardener tube and the closure member removed. The apparatus is then loaded and ready for use. Since the end surface 44 can be so readily cleaned, little if any mastic, hardener or combination thereof is likely to spill onto the dispensing apparatus thereby increasing the cleanliness of the apparatus use and enhancing the lifetime thereof. The extra cleanliness that the present invention produces allows better dispensing of accurate amounts of mastic and hardener. Moreover, at the end of a day the lid 55 can be flipped down to cover the exit apertures 45 and 56 with a good seal preventing drying out of any mastic or hardener in the bodies 47 and 48 respectively. The depth of the lid 55 can be increased in order to stop the lid inner surface from coming into contact with the mastic and hardener that remains at the end of the exit apertures after use. In this way, when the lid is opened again, there is no pulling effect on the mastic and hardener which can cause them to string. slightly. After the cartridge is empty, a new cartridge and hardener is simply loaded into the dispensing apparatus.

It will be apparent that the sizes of the exit apertures 45 and 56 are selected to provide a suitable volume of mastic and hardener during dispensing. It can be seen from FIG. 5 that although the lower entrance of the body 48 is large enough to receive the hardener tube 57, the exit aperture is or reduced size to restrict flow of hardener.

Although a closure member can be provided in the body 47 after filling of the cartridge 43, it will be apparent that the hinged lid can be constructed to form a suitable closing of the cartridge for sale.

Preferably, the attachment 40 is permanently connected to the cartridge 43 and is discarded when the cartridge 43 is empty. This can be achieved by integrally forming the attachment with the cartridge. It will be apparent that the attachment 40 could be adapted to function with dispensing apparatus other than those shown in FIGS. 1, 2 and 6.

It will be appreciated that the nozzle attachment of the present invention is not limited to use with the cartridges described herein.

We claim:

1. A dispensing nozzle attachment for a generally cylindrical cartridge to be mounted in use to a dispensing apparatus, comprising:

a hollow primary nozzle section having a connection means at one end for connection to the cartridge and having a first dispensing exit aperture at another end;

a hollow secondary nozzle section having a connection means at one end for connection to a further cartridge and having a second dispensing exit aperture at another end;

a substantially rigid portion linking said primary nozzle section and said second nozzle section together, so that said first dispensing exit aperture and said second dispensing exit aperture are spaced a distance apart, and said first dispensing exit aperture and said second dispensing exit aperture define an uninterrupted dispensing exit plane, and said substantially rigid portion linking said primary nozzle section and said secondary nozzle section together comprises a planar section linking said first dispensing exit aperture and said second dispensing exit aperture to provide a substantially continuous surface as said uninterrupted dispensing exit plane; and said primary nozzle section has a generally tubular body and said secondary nozzle section has a generally tubular body, the bodies being connected by said substantially rigid portion to be substantially parallel.

2. The dispensing nozzle attachment as claimed in claim 1, wherein said primary nozzle section connection means is permanently connected to the cartridge and the secondary nozzle section connection means comprises a releasable connection means for attachment to the further cartridge.

3. The dispensing nozzle attachment as claimed in claim 1, wherein said primary nozzle section connection means comprises a push fit connection to the cartridge.

4. The dispensing nozzle attachment as claimed in claim 3, wherein said primary nozzle section connection means pivotally connects to the cartridge.

5. The dispensing nozzle attachment as claimed in claim 1, wherein said body of said primary nozzle section includes locating means for mounting the attachment to a dispensing apparatus.

6. The dispensing nozzle attachment as claimed in claim 5, wherein said locating means comprise a groove.

7. The dispensing nozzle attachment as claimed in claim 6, further including locking means for cooperating, in use, with a dispensing apparatus to prevent rotation of the cartridge when mounted to the dispensing apparatus.

8. The dispensing nozzle attachment as claimed in claim 1, wherein the dispensing nozzle attachment is formed as an integral piece of plastics material.

9. The dispensing nozzle attachment as claimed in claim 1, including a pivotally connected lid means for closing said first dispensing exit aperture and said second exit dispensing aperture.

10. A dispensing apparatus comprising:

a dispensing nozzle attachment for a generally cylindrical cartridge to be mounted in use to the dispensing apparatus, comprising:

a hollow primary nozzle section having a connection means at one end for connection to the cartridge and having a first dispensing exit aperture at another end;

a hollow secondary nozzle section having a connection means at one end for connection to a further cartridge and having a second dispensing exit aperture at another end; and a substantially rigid portion linking said primary nozzle section and said secondary nozzle section together, so that said first dispensing exit aperture and said second dispensing exit aperture are spaced a distance apart, and said first dispensing exit aperture and said second dispensing exit aperture define an uninterrupted dispensing exit plane; and the dispensing apparatus comprising:

a main body member;

a cartridge holding portion connected to said main body member; and a drive means mounted on said main body member; and an advance mechanism attached to said main body member for advancing the drive means to push against a held cartridge to force out material contained therein;

wherein said cartridge holding portion includes a bayonet fitting for cooperating with a received cartridge to fixedly hold the cartridge to the apparatus.

11. The dispensing apparatus as claimed in claim 10, including slots for the bayonet fitting on said cartridge holding portion to cooperate with pins provided on the cartridge.

12. The dispensing apparatus as claimed in claim 10, wherein said cartridge holding portion comprises at least three side flanges defining a receiving area for the cartridge, each of said at least three side flanges including a bayonet fitting.

13. The dispensing apparatus as claimed in claim 10, wherein said cartridge holding portion and said main body portion comprise a single, integrally formed piece of metal.

14. The dispensing apparatus as claimed in claim 13, wherein said single, integrally formed piece of metal is formed into the main body portion and cartridge holding portion by stamping and bending of the metal.

* * * * *